US008109781B2

(12) United States Patent
Koellmann

(10) Patent No.: US 8,109,781 B2
(45) Date of Patent: Feb. 7, 2012

(54) CONNECTION ADAPTER/TERMINAL SET AND CORRESPONDING CONNECTION ADAPTER AND TERMINAL

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 12/936,347

(22) PCT Filed: Mar. 26, 2009

(86) PCT No.: PCT/EP2009/002214

§ 371 (c)(1),
(2), (4) Date: Dec. 2, 2010

(87) PCT Pub. No.: WO2009/124662

PCT Pub. Date: Oct. 15, 2009

(65) Prior Publication Data

US 2011/0104932 A1 May 5, 2011

(30) Foreign Application Priority Data

Apr. 8, 2008 (DE) ..... 10 2008 017 915
May 19, 2008 (DE) ..... 10 2008 024 172

(51) Int. Cl.
*H01R 13/64* (2006.01)

(52) U.S. Cl. ..... 439/374

(58) Field of Classification Search ..... 439/374, 439/378, 157, 310, 347, 557
See application file for complete search history.

(56) References Cited

U.S. PATENT DOCUMENTS

| | | | | |
|---|---|---|---|---|
| 5,827,091 | A * | 10/1998 | Briski et al. | 439/594 |
| 6,837,750 | B2 * | 1/2005 | Fukuda et al. | 439/680 |
| 6,843,677 | B2 * | 1/2005 | Fukuda | 439/374 |
| 6,851,980 | B2 * | 2/2005 | Nelson et al. | 439/607.05 |
| 7,601,020 | B2 * | 10/2009 | Yoshida et al. | 439/374 |
| 7,896,684 | B2 * | 3/2011 | Guillanton | 439/374 |

FOREIGN PATENT DOCUMENTS

| | | |
|---|---|---|
| EP | 0 477 548 | 8/1991 |
| EP | 1 388 914 | 8/2003 |
| EP | 1 681 747 | 12/2005 |

* cited by examiner

*Primary Examiner* — Jean F Duverne
(74) *Attorney, Agent, or Firm* — Whitham Curtis Christofferosn & Cook, PC

(57) ABSTRACT

A connection adapter has electrical contacts for connection to a corresponding mating contact of a terminal. The mating contacts are received in terminal domes formed from an insulating material which is configured such that the mating contacts are accessible to a contact of the connection adapter through a contact guide opening in a terminal dome. Connection adapter guides in the terminal domes are configured to interact with terminal guides to guide the connection adapter from a placement position, where it is placed onto the terminal in the correct position where the connection adapter and terminal can be fitted together, to detent position, where the connection adapter is placed and held on the terminal so that the electrical contacts of the connection adapter and the mating contacts of the terminal can be moved relative to each other to establish electrical contact.

21 Claims, 8 Drawing Sheets

CONNECTION ADAPTER/TERMINAL SET AND CORRESPONDING CONNECTION ADAPTER AND TERMINAL

The invention relates to a set comprising a connection adapter and a connection terminal, with the connection adapter having electrical contacts for connection to corresponding mating contacts of the connection terminal, the mating contacts each being accommodated in a connection terminal dome, which is formed from insulating material, such that the mating contacts are accessible to a contact of the connection adapter through a respective contact guide opening in the associated connection terminal dome, and with the connection terminal domes having plug guides which are designed to cooperate with corresponding socket guides on the connection adapter for guiding the connection adapter from a mounting position, in which the connection adapter is mounted on the connection terminal in a matching manner and from which the connection adapter and connection terminal can be plug-connected, to a latching position, in which the connection adapter is seated and held on the connection terminal such that the electrical contacts of the connection adapter and the corresponding mating contacts of the connection terminal can be moved relative to one another in order to make electrical contact.

The invention also relates to a connection terminal and to a connection adapter for a set of this kind. The connection adapter of this generic type has an upper housing part which is mounted on a lower housing part such that it can move relative to the lower housing part, and accommodates adapter contacts which can be moved together with the upper housing part, and having a protective plate which has passage openings for the adapter contacts and is mounted such that it can be moved relative to the adapter contacts in such a way that the adapter contacts are recessed in the upper housing part such that they are concealed by the protective plate in an inoperative position in which the connection adapter is disconnected from a corresponding device connection terminal, and project through the passage openings in the protective plate into clamping points of the device connection terminal in a clamping position in which the connection adapter is mounted at least partly on a corresponding device connection terminal.

Sets of this kind comprising a connection adapter and a connection terminal are used, for example for connecting power supply lines to luminaires. In this case, the power supply cable may be live. This is dangerous for the service personnel and problematic particularly if the luminaire is being connected by a layperson.

DE 10 2004 030 440 B4 discloses a luminaire connection adapter with protruding plugs which are inserted into a luminaire terminal which is incorporated in a luminaire housing. When the supply lines of the luminaire connection adapter are live, there is a risk of injury on account of the lack of protection against electric shocks.

EP 0 889 550 B1 describes a two-part electrical connection with a moveable protective cover which provides electric shock protection for the connected conductors for one of the two connection plugs. The protective cover is in the form of a flap which is fitted to the external housing and is pivoted by engaging in an inclined guide path of the mating plug.

A similar flap-type mechanism for electric shock protection for a plug is described in DE 103 36 082 A1. The other part of the plug pair is not protected in this document either.

Many embodiments of connection systems without electric shock protection are known, for example from DE 102 36 398 B3, DE 100 11 613 A1, U.S. Pat. No. 3,860,739 A1, U.S. 2002/0064039 and U.S. Pat. No. 5,015,203.

EP 1 150 399 B1 discloses a multi-pole electrical connection connector with an electric shock protection flap for preventing access to at least some of the conductor connections of one of the connection units when the conductor connections of the other connection unit, which conductor connections correspond to the first-mentioned conductor connections, are occupied. The flap is arranged on the external housing in front of the plug access and is connected to a further flap of the associated conductor connection of the other connection unit by means of a lifting mechanism.

U.S. Pat. No. 5,885,109 A1 describes an electrical adapter with a spring-loaded protective plate in front of the connection sockets which are protected by the protective plates. In order to connect a plug to the power outlet which is formed from the sockets, the protective plate is grasped by the unprotected plugs and moved counter to the spring force until the apertures in the protective plate, in which the plugs engage, expose the sockets situated behind them.

An electrical protection apparatus of this kind, also known as a child-proof guard, is also known from DE 27 429 A1 or, in a rotatable embodiment of the moveable, spring-loaded protective plate, from DE 87 15 967 U1. Child-proof guards of this kind for power outlets can also be provided as separate insertion parts which are plugged into the power outlets. This is described in DE 87 15 967 U1 and DE 85 19 135 U1.

However, with this type of electric shock protection, it is necessary to ensure that the line connections protruding from the plug are not live. This cannot necessarily be ensured in the case of a luminaire connection for example since, in this case, for reasons of space, the connection socket is generally incorporated in the luminaire and the connection plug is connected to the supply line, which carries voltage potential, in order to avoid protruding parts during installation.

EP 1 681 747 A2 discloses an electrical device connection for a luminaire with a connection terminal which is clipped into the luminaire housing and a plug-type connector which can be connected to said connection terminal and has a plurality of plug or socket contacts for external connection to a power supply cable. The connection contacts of the plug-type connector, which connection contacts engage in the luminaire connection terminal, are incorporated in a contact carrier slide which is mounted in a longitudinally moveable manner on the plug-type connector housing. An electrically conductive connection between the connection contacts and the plug or socket contacts, and power supply cables which may be connected to said contacts, is established by means of connection clip contacts in the contact carrier only after the contact carrier slide is moved to a final installation position in the direction of the connection terminal which adjoins the plug-type connector, and the connection contacts of the plug-type connector have engaged in the connection sockets of the connection terminal. This prevents the connection contacts which project from the plug-type connector from being able to be live outside the final installation position. By virtue of a blocking stop on the contact carrier slide, which blocking stop engages in a mating stop of the connection terminal, the contact carrier slide which is fixed by the blocking stop in a final assembly position is released and can further be moved in the direction of the connection terminal in order to connect the connection contacts of the plug-type connector to the connection sockets of the connection terminal.

Different embodiments of connection adapters and connection terminals are provided with different connection assignments. In this case, it is necessary to prevent incorrect plug-connection of connection adapters and connection terminals with different connection assignments which do not belong together. However, at the same time, it is necessary to ensure, by way of a suitable refinement, that live connection contacts are guided in a manner such that they are provided with electric shock protection and, in the process, the connection adapter and connection terminal are firmly latched to one another in the latching position; this design should be identical for all pole types.

Therefore, the object of the present invention is to provide an improved set comprising a connection adapter and a connection terminal.

The object is achieved by a set of the type cited in the introductory part in that the connection adapter guides and connection terminal guides are also matched to one another such that a coding is provided as a function of the provided connection assignment of the contacts present in the connection adapter and the connection terminal for making mutual contact, said coding permitting a connection adapter to be guided on a connection terminal, or vice versa, only given a corresponding connection assignment.

In the case of an n-pole adapter or terminal (where n=2, 3, 4, 5 or more), a connection assignment is defined by the line functions associated with the individual connections, for example protective grounding conductor (E), neutral conductor (N), phase conductor (L). Incorrect plug-connection of connection adapters and connection terminals of the same style, that is to say within the same plugging system, but of different type can then be prevented, even when they have the same number of poles, on account of the different connection assignment. However, the connection assignment can also include the number of contacts present for making mutual contact.

According to the teaching of the present invention, the connection adapter guides and connection terminal guides which are used for guiding the connection adapter on the connection terminal and for latching purposes are also employed as coding elements. In this case, the connection adapter guides and connection terminal guides are matched to one another such that it is possible to mount, guide and latch a connection adapter on a connection terminal only given a corresponding connection assignment. Therefore, the connection adapter guides and connection terminal guides differ as a function of the connection assignment, while the guiding and latching function remains the same. According to the invention, the mounting, guiding and latching projections and recesses are also used for coding purposes, this requiring considerable complex consideration in terms of design but being associated with significant advantages in terms of production and application.

The use of the connection adapter guides and connection terminal guides as coding elements has the advantage that no additional projections and corresponding recesses are required as codings. The projections and recesses which are present in the connection adapter guides and connection terminal guides in any case can be used for this purpose, without this having an adverse effect on the actual intended purpose of guiding and latching the connection adapter and connection terminal.

The guides can be formed by projections and recesses in the insulating material of the connection terminal dome and in a corresponding plug attachment region of the connection adapter. In the process, a projection, for example on the insulating material housing of the connection adapter, engages in a recess in the insulating material of the connection terminal dome of the connection terminal, and therefore the connection adapter can be mounted on the connection terminal given a matching connection assignment. The projection can subsequently be guided by the recess to a latching position in which the connection adapter is latched to the connection terminal by the projection resting on the connection adapter by means of a further projection on the connection terminal dome and therefore exerting a holding function. The projections and recesses which define the guides are therefore first designed for the purpose of providing a coding, then for the purpose of providing a guide and, in the latching position, for the purpose of providing a holding function.

Those sections of the guides which form a coding are preferably located at the free end of the connection terminal dome, that is to say at that end at which the connection adapter first touches the connection terminal during the mounting process. Therefore, a connection adapter which does not match is prevented from being mounted as early as before the movement process, that is to say at the beginning of the process in which the connection adapter is mounted on the connection terminal. This is advantageous over an embodiment in which the guides initially allow first guidance of the connection adapter onto the connection terminal independently of the connection assignment of the connection adapter and the connection terminal, and then latching is prevented by a coding during guidance of the connection adapter and connection terminal to a latching position when the connection assignment is not the same.

The connection terminal domes which are provided for all or some of the electrical contacts are preferably integrally formed with an insulating material housing of the connection terminal. This allows simple production and reliable insulation. In addition, latching spring elements can be integrally formed on the connection terminal domes in a manner which is known per se, it being possible for the connection terminal to be detachably fastened to a carrier plate, for example a luminaire plate of a luminaire, by way of said latching spring elements.

As already described above, the connection adapter guides and the connection terminal guides preferably define a guide path of the kind such that, in a first step of the contact-making process, the connection adapter and connection terminal can be moved toward one another. The connection adapter and connection terminal can be moved transverse to one another after a stop position is reached, until a latching position is reached, it being possible for the electrical contacts in the connection adapter to be moved toward one another relative to the corresponding mating contacts for making mutual contact in said latching position.

The object is also achieved by a connection terminal for a set of this kind, said connection terminal having a plurality of mating contacts which are each accommodated in an associated connection terminal dome formed from insulating material and which are each accessible to a contact of a connection adapter via a contact guide opening in the connection terminal dome. The connection terminal domes have connection adapter guides which are designed to with corresponding connection terminal guides on a matching connection adapter for guiding the connection adapter from a mounting position, in which the connection adapter is mounted on the connection terminal in a matching manner and from which the connection adapter and the connection terminal can be plug-connected, to a latching position, in which the connection adapter is seated and held on the connection terminal such that the electrical contacts of the connection adapter and the corresponding mating contacts of the connection terminal can be moved relative to one another in order to make electrical contact. The connection adapter guides are also matched to one another such that a coding is provided as a function of the connection assignment of the mating contacts present in the connection terminal for making contact with contacts of a matching connection adapter, said coding permitting a connection adapter to be guided on the connection terminal, or vice versa, only given a corresponding connection assignment.

The object is also achieved by a connection adapter for a set of this kind. The connection adapter also has a plurality of electrical contacts in an insulating material housing, which contacts are accommodated in a manner protected against contact from the outside by a protective plate in the unlocked state, and having unlocking elements which, after a latching position is reached, allow the electrical contacts to move through openings in the protective plate in the direction of mating contacts of a connection terminal. Connection terminal guides are integrally formed in the insulating material housing adjacent to the contacts in such a way that the connection adapter from a mounting position, in which the connection adapter is mounted on the connection terminal in a matching manner and from which the connection adapter and connection terminal can be plug-connected, to a latching position, in which the connection adapter is seated and held on the connection terminal such that the electrical contacts of the connection adapter and the corresponding mating contacts of the connection terminal can be moved relative to one another in order to make electrical contact. The socket guides are also matched to one another such that a coding is provided as a function of the connection assignment of the contacts present in the connection adapter for making contact with mating contacts of a matching connection terminal, said coding permitting the connection adapter to be guided on a connection terminal, or vice versa, only given a corresponding connection assignment.

For explanatory purposes, it should be noted that, in addition to the mating contacts which are accommodated in the connection terminal domes or contacts which are accessible via said mating contacts, further mating contacts can be present in the connection terminal or contacts may be present in the connection adapter. Therefore, a PE contact for reliable ground connection may be present, for example on the connection adapter. However, this does not have any effect on the basic principle of the present invention.

A further object of the present invention is to provide an improved connection adapter, in particular for a set of the above-described type, which is of simple and compact design.

The object is achieved by way of the connection adapter of the type cited in the introductory part in that the protective plate is mounted in the lower housing part and at least one plug contact arrangement is incorporated in the upper housing part, said plug contact arrangement in each case having a group of connection contacts which are electrically conductively connected to associated adapter contacts.

The integration of the at least one plug contact arrangement, together with the adapter contacts which project downward in the direction of the lower housing part, in the upper housing part has the advantage that the adapter contacts are rigidly connected to the associated connection contacts of the at least one plug contact arrangement and can be moved together with the upper housing part. The rigid connection between adapter contacts and associated connection contacts allows a reliable electrical contact-connection with a high current-carrying capacity. In contrast, the protective plate which forms electric shock protection for the connection contacts in the inoperative state is incorporated in the lower housing part. On account of the incorporation of the plug contact arrangements of the upper housing part, there is now sufficient space to guide the protective plate. The overall height of the connection adapter can be reduced in this way.

It is particularly advantageous for latching hooks to project from the lower housing part. The latching hooks can be used to align and mount the connection adapter on a device connection terminal by the latching hooks being aligned with openings in a mounting plate, with the device connection terminal likewise being connected to the mounting plate. The insertion position of the latching hooks in the openings then defines the correct mounting position on the device connection terminal.

The upper housing part then has to have locking fingers which are matched to the latching hooks, with the latching hooks and locking fingers being designed such that, after the lower housing part is latched by the latching hooks engaging in the opening in a mounting plate, the locking fingers can be positioned in the openings when the upper housing part moves behind the latching hooks, and in this way the latching hooks are stopped froth being drawn out of the openings.

This utilizes the fact that a portion of the openings are released again after the latching hooks are inserted into the openings and the connection adapter is moved to the locking position. These released portions of the openings are filled by the locking fingers when the upper housing part is moved downward in the direction of the mounting plate.

It is also advantageous for the lower face of the lower housing part, which lower face is intended to rest on a device connection terminal, to have guide profiles which are matched to projecting domes of the device connection terminal for pushing on and latching the connection adapter to the device connection terminal. The lower face of the lower housing part is therefore designed with the aid of the guide profiles such that the connection adapter can be mounted on the device connection terminal only in a permissible position, with the movement of the connection adapter to a latching position then being prespecified by the guide profiles.

The integration of the plug contact arrangement in this upper housing part has the advantage that the connection contacts of at least one of the plug contact arrangements can be in the form of insulation-displacement terminal contacts. Therefore, a single- or multi-core line can be guided along the upper face of the upper housing part and be connected to insulation-displacement terminal contacts which project from the upper face of the upper housing part opposite the lower housing part.

In this case, the insulation-displacement terminal plug contact arrangement is preferably arranged directly above the adapter contacts in the upper housing part. The lines are guided to the insulation-displacement terminal contacts and said lines are locked by a guide attachment which has latching elements for latching onto the upper face of the upper housing part and line guide elements for laying and guiding lines to associated insulation-displacement terminal connection contacts. The line guide elements can be in the form of cavities with a cross section in the form of part of a circle and with recesses for the free ends of the insulation-displacement terminal contacts. The guide attachment can be mounted on the upper housing part as a separate part or else can be pivotably connected to the upper housing part.

However, connection contacts of at least one of the at least one plug contact arrangement can also be in the form of spring-force terminal connections. Suitable spring-force terminal connections include, for example, cage tension spring connections, and pressure contact connections, for example knife-and-fork contacts or the like.

The two plug contact arrangements can be arranged opposite one another in the upper housing part, so that corresponding connection contacts of the two opposite plug contact arrangements are connected through and at least one associated adapter contact can be used to tap off power from the connected-through line. The adapter contacts are then arranged in the intermediate space between the two opposite plug contact arrangements and project transverse to the alignment between the two plug contact arrangements downward in the direction of the lower housing part.

It is also feasible for at least two plug contact arrangements to be arranged vertically one above the other on one side of the upper housing part. In this case, further plug contact arrangements may be present opposite the plug contact arrangements which are situated one above the other, said further plug contact arrangements for their part once again being arranged one above the other as seen in the movement direction of the adapter contacts.

The protective plate can have at least one guide element, for example a holding finger, which projects downward in the direction of the connection face for a connection terminal, or an opening for accommodating a holding finger of the connection terminal for holding the protective plate in a fixed position with respect to the connection terminal when the holding finger interacts with the device connection terminal, while the lower and upper housing parts are moved relative to the protective plate when latching onto the connection terminal in order to align the passage openings with the adapter contacts.

While the protective plate conceals the adapter contacts in the inoperative position in which the connection adapter is not fastened to a connection terminal, when the connection adapter is mounted and pushed onto a connection terminal, the protective plate is displaced relative to the upper and lower housing parts and the adapter contacts such that the passage openings are aligned with the adapter contacts and the adapter contacts can be moved through the passage openings in the direction of corresponding terminals of an adjacent connection terminal. When the connection adapter is mounted, the passage openings in the protective plate are already aligned with insertion openings which lead to contacts in the device connection terminal and the protective plate is fixed in this position relative to connection terminals with the aid of the guide element, for example a holding finger. The upper and lower housing parts are then moved, together with the adapter contacts, relative to the protective plate and the connection terminal until the adapter contacts can be moved, in the direction of the connection terminal, through the passage openings and insertion openings in order to make contact with corresponding contacts. A locking bar prevents the adapter contacts from being prematurely pushed down onto the protective plate and prevents the connection adapter from being prematurely withdrawn from the connection terminal under excessive loading of the adapter contacts, said locking bar sliding into the connection terminal, through locking bar gaps which are aligned in this case, only in the connection position, and therefore securing the connection adapter in a position relative to the connection terminal.

It is possible to protect the adapter contacts from contact in this way in a simple and compact manner with the aid of the lower and upper housing parts and the integration of the adapter contacts in the upper housing part and the integration of the protective plate in the lower housing part.

The adapter contacts can each be integrally formed with associated connection contacts of the at least one plug contact arrangement. However, for reasons of assembly, it is expedient, under certain circumstances, for the adapter contacts to be produced separately from the connection contacts with the busbar sections arranged thereon and for an electrically conductive connection of the adapter contacts to associated connection contacts to be established when the adapter contacts are fitted in the upper housing part.

When the at least one plug contact arrangement is integrated in the upper housing part, the problem of the upper housing part potentially being withdrawn from the connection terminal, possibly with damage to the latching mechanisms, may arise due to lines which are connected to the plug contact arrangements being pulled. Therefore, it is advantageous for the upper housing part to be secured to the lower housing part with the aid of latching clips after being fastened to a connection terminal, said latching clips latching the lower and upper housing parts to one another.

It is also advantageous for the lower and upper housing parts to be connected to one another by means of guide tabs, with the guide tabs having stop lugs which prevent the upper housing part being withdrawn from the lower housing part and, when the upper housing part is pushed onto the lower housing part, lead to the upper housing part being in the latching position in order to prevent tilting.

The invention will be explained in greater detail in the text which follows with reference to exemplary embodiments together with the appended drawings, in which.

Figure 5:
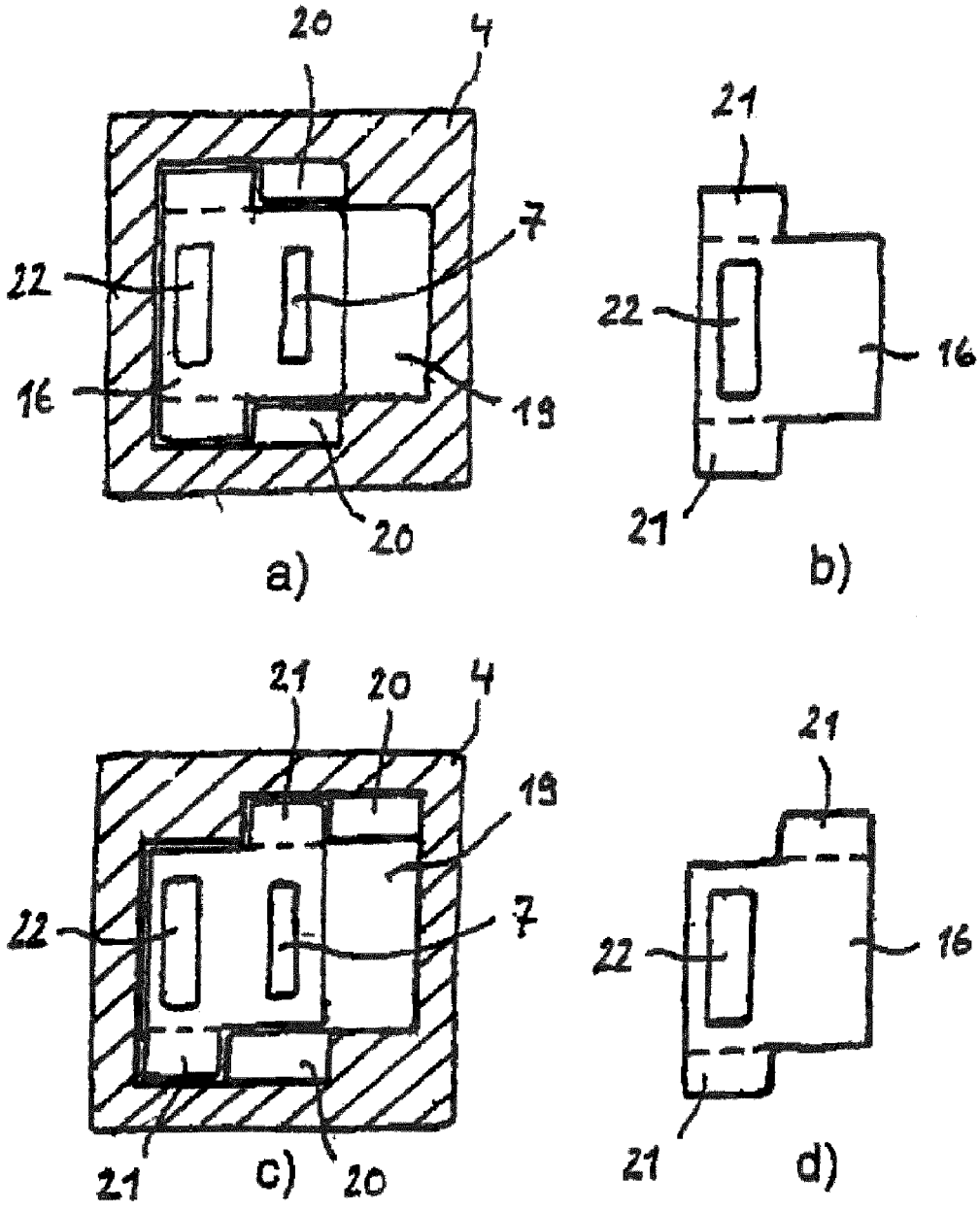
Figure 6:
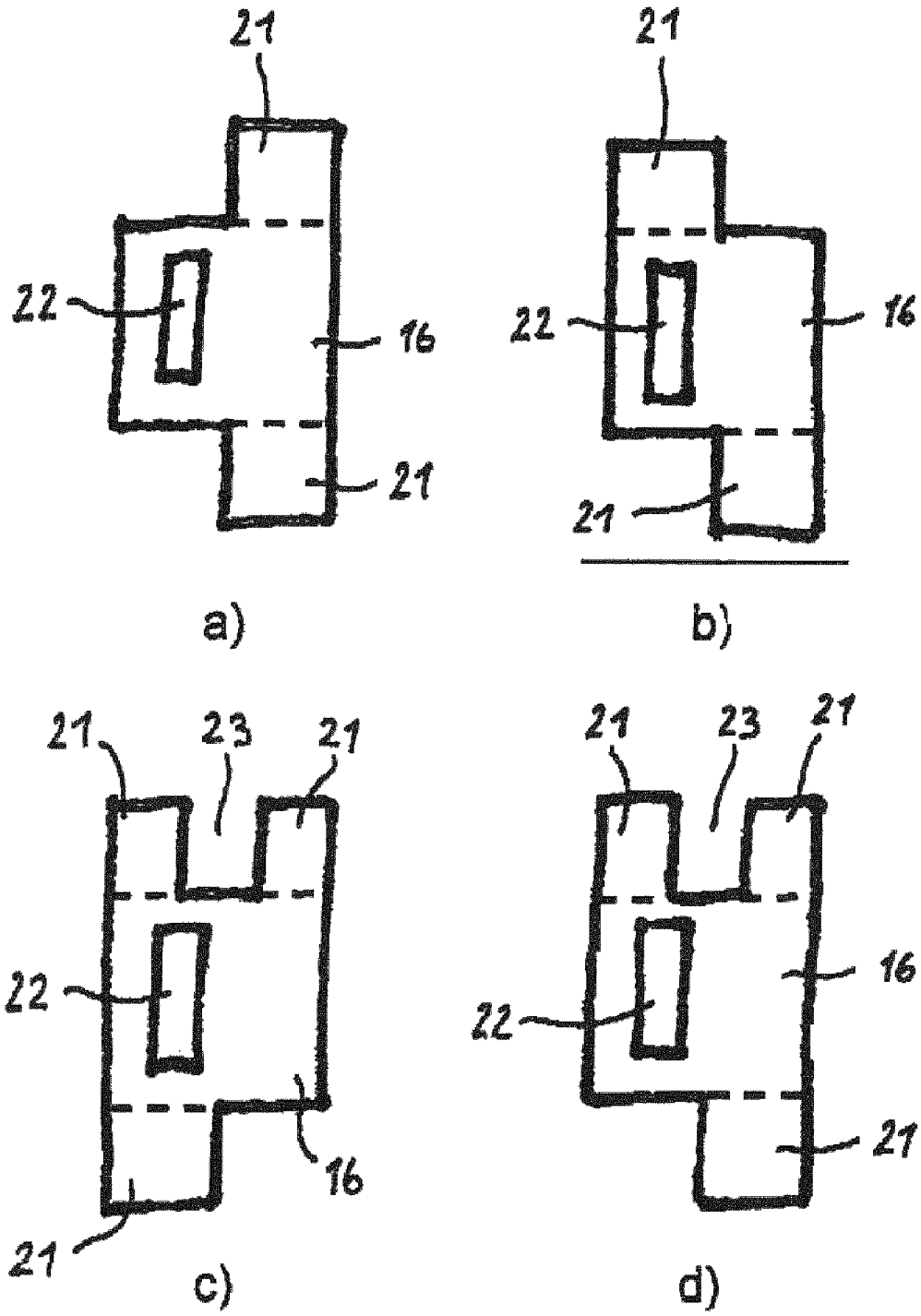
Figure 7:
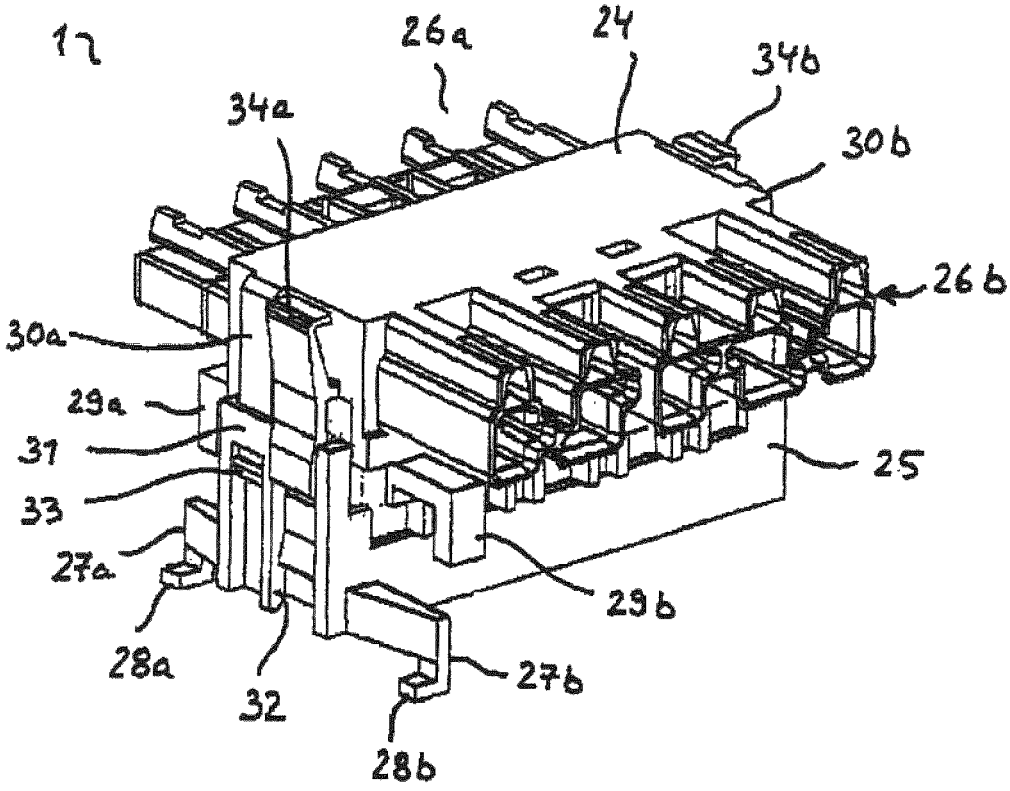
Figure 8:
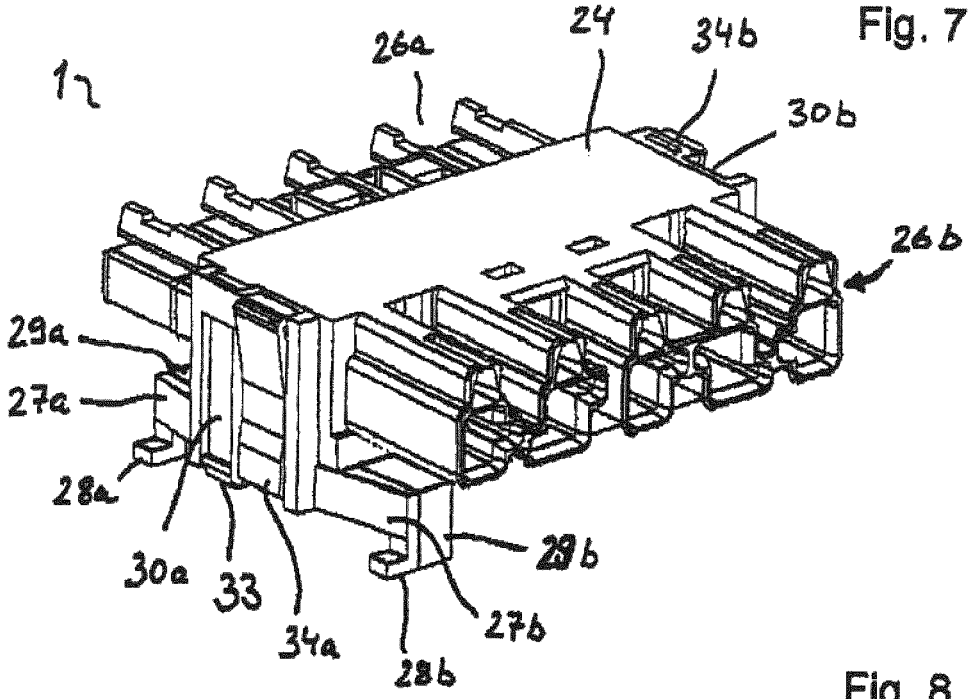
Figure 9:
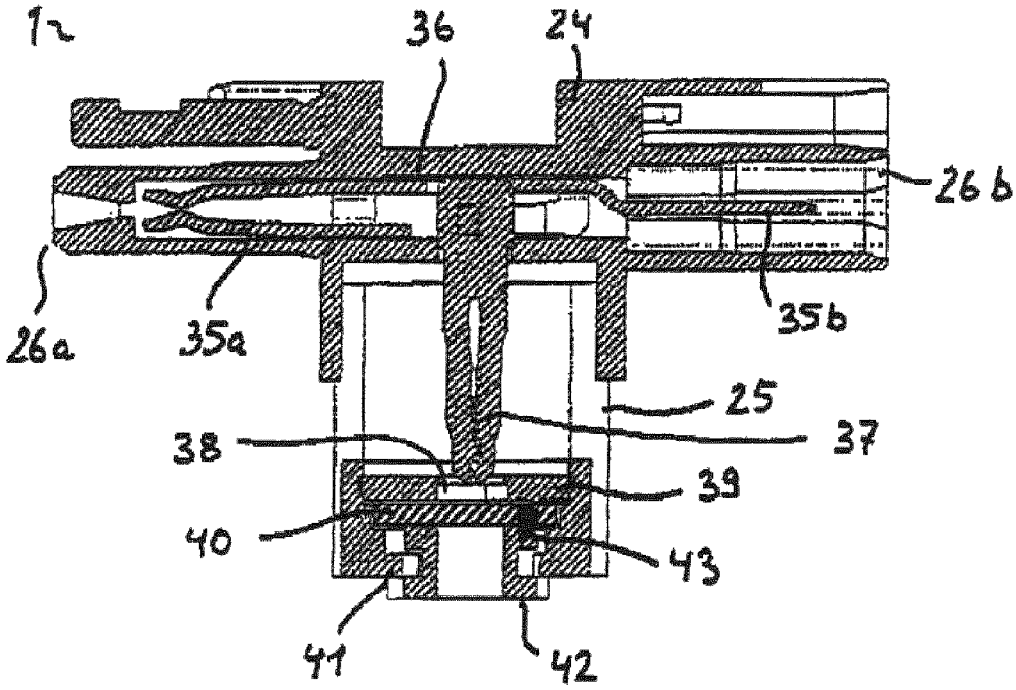
Figure 10:
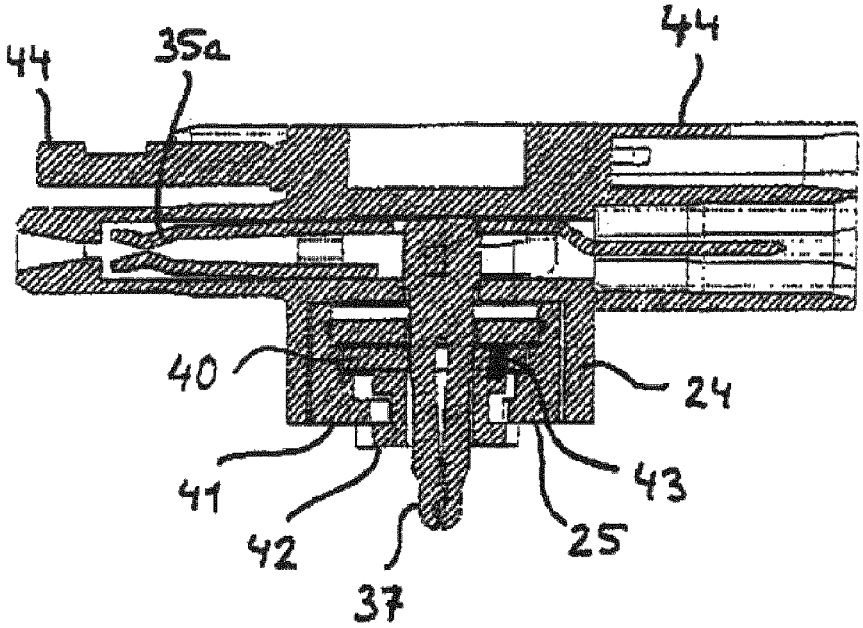
Figure 11:
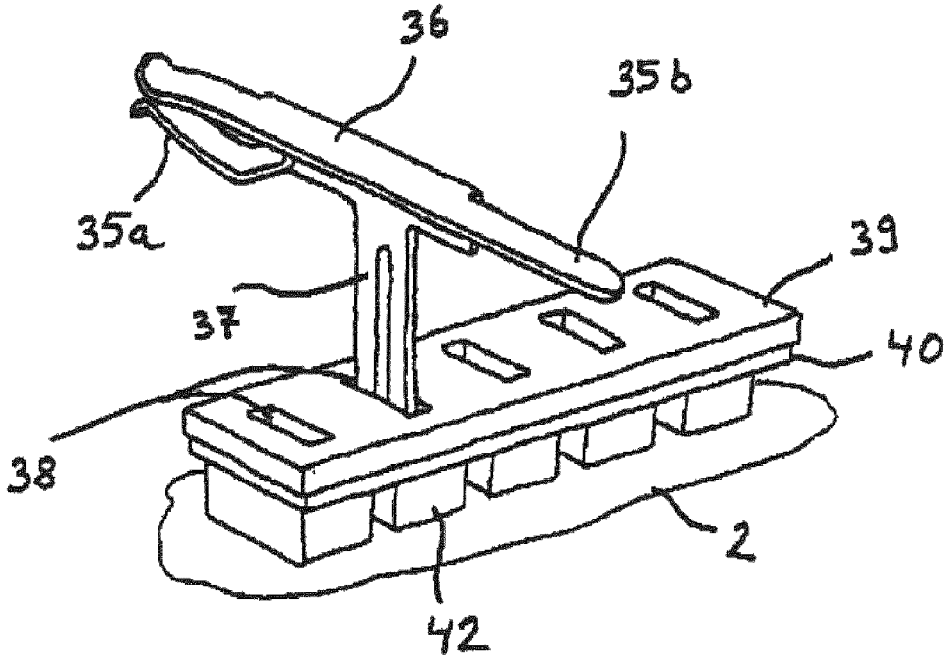
Figure 12:
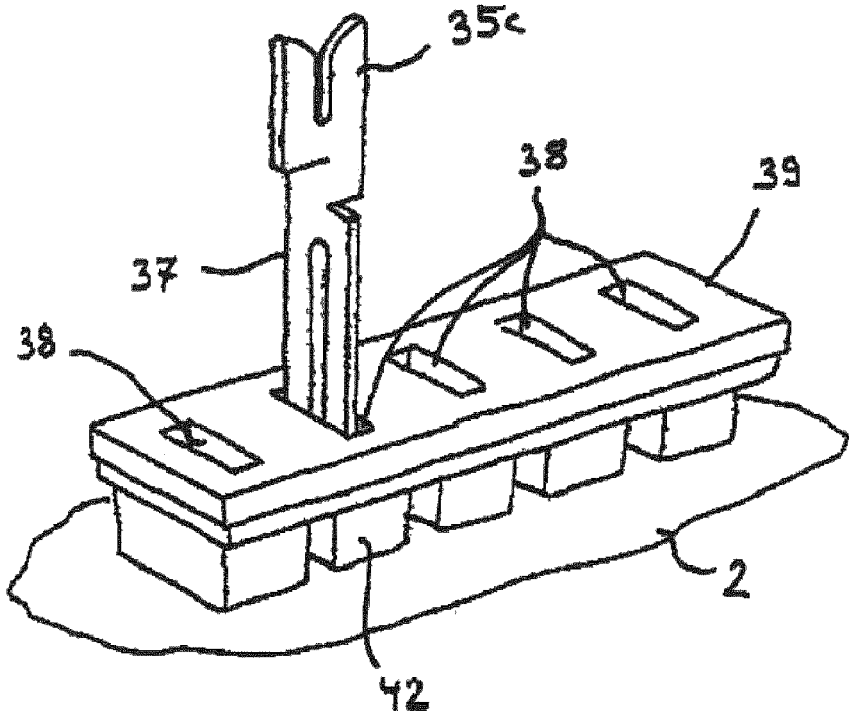
Figure 13:
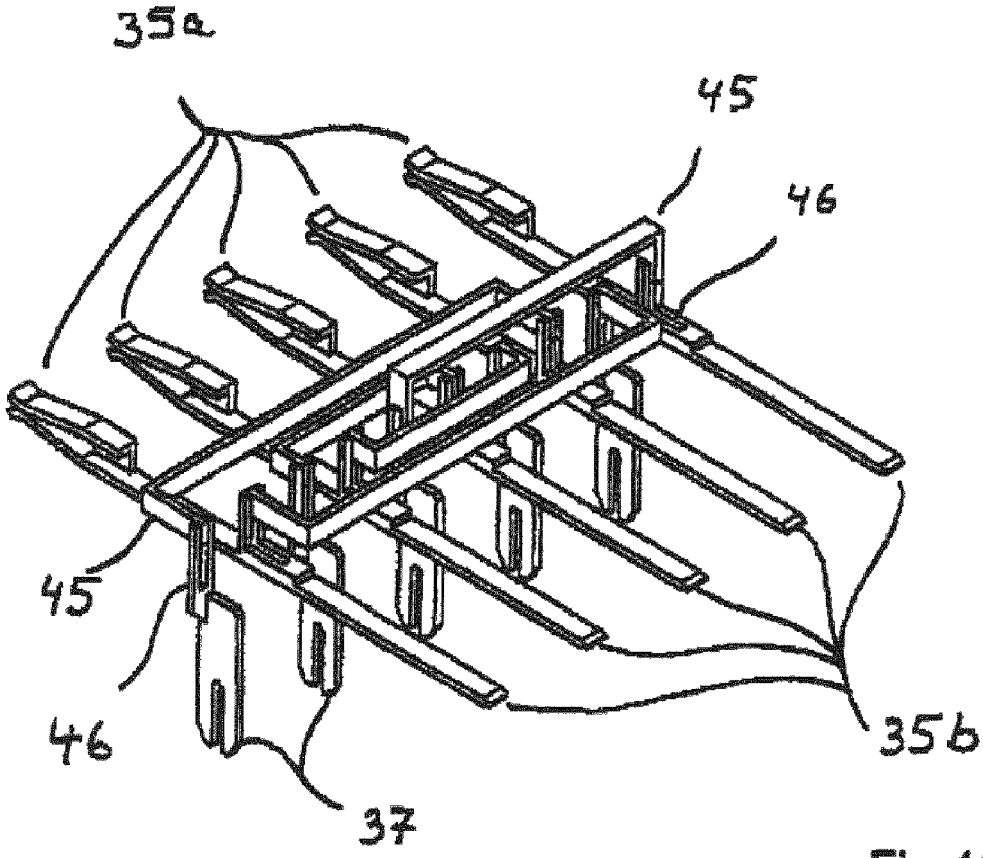

FIGS. 4*a*) and *b*) show plan views of the connection region of a connection adapter with the connection terminal dome of a connection terminal inserted, in a stop position and a latching position;

FIGS. 5*a*) to *d*) show different embodiments of the connection adapter guides and connection terminal guides;

FIGS. 6*a*) to *d*) show sketches of different embodiments of connection adapter guides;

FIG. 7 shows a perspective view of a connection adapter in the inoperative position;

FIG. 8 shows a perspective view of the connection adapter from FIG. 7 in the clamping position;

FIG. 9 shows a sectional view through the connection adapter from FIG. 7 with terminal domes of a device connection terminal;

FIG. 10 shows a sectional view through the connection adapter from FIG. 8 with terminal domes of a device connection terminal;

FIG. 11 shows a sketch of a detail of a rigid connection of connection contacts, which are opposite one another, to connection terminals which project perpendicular to said connection contacts, said connection passing through a guide plate, protective plate and domes of a device connection terminal;

FIG. 12 shows a sketch of a detail of connection terminals with integrally formed insulation-displacement terminal connection contacts which are oriented upwards; and FIG. 13 shows a perspective view of a connection adapter with bridges situated above the adapter contacts.

Figure 1:
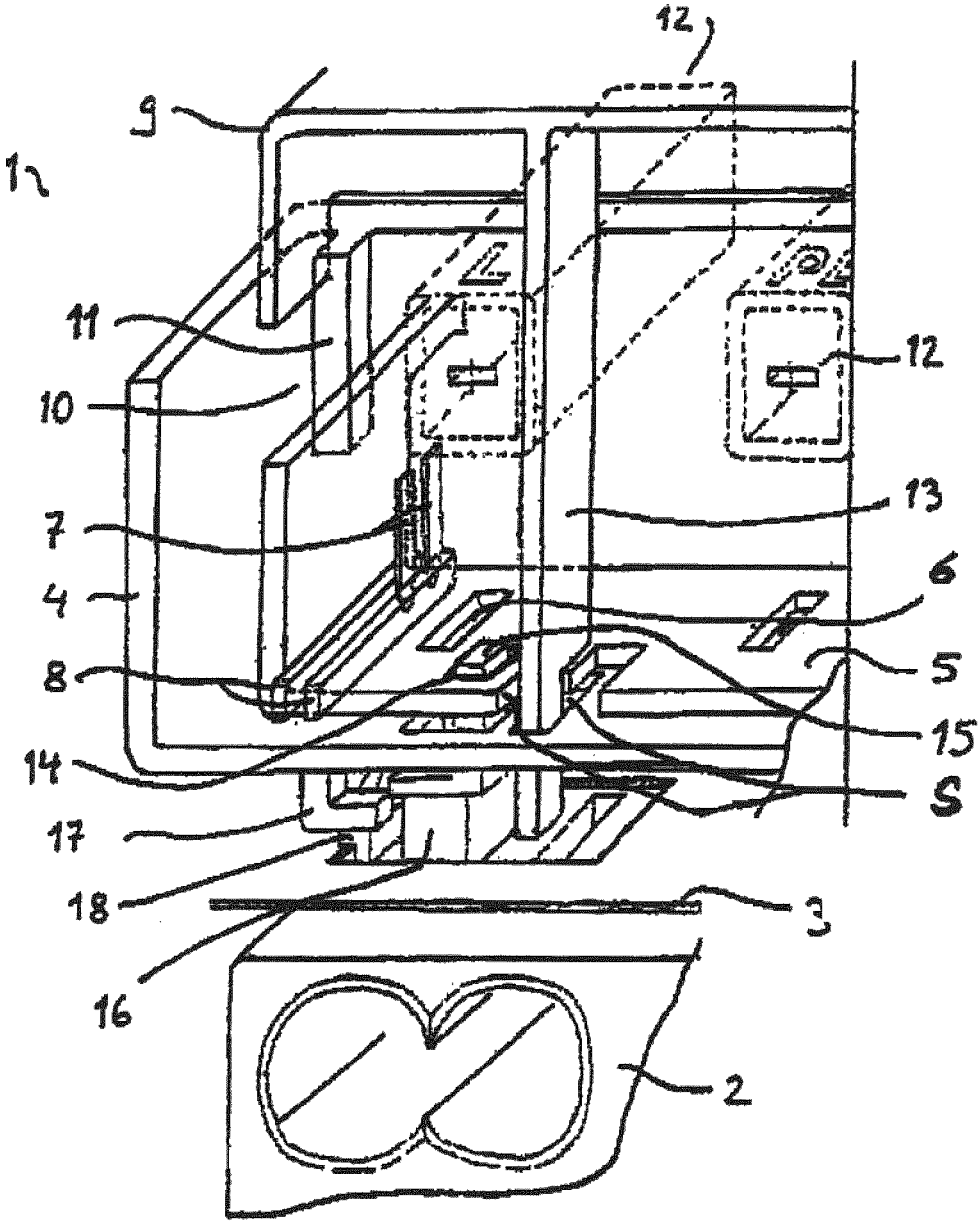
FIG. 1 shows a perspective sectional view of one embodiment of a connection adapter which is mounted on a connection terminal.

FIG. 1 shows a perspective sectional view of a connection adapter 1, which is described in detail in DE 10 2007 044 661.8, dated Sep. 18, 2007, which is intended to be clamped to a connection terminal 2 of an electrical device, for example a luminaire. In this case, the connection terminal 2 is plugged into a device housing plate 3 of the electrical device and fixed there.

Reference is made to DE 10 2007 044 661 with respect to the exemplary embodiments, it being possible for said document to be particularly suitably used in conjunction with the special refinement of the connection adapter guides and connection terminal guides described here for coding, guiding and latching purposes.

The connection adapter 1 has an insulating material housing 4, a protective plate 5 being incorporated in the interior of said housing, said protective plate being, for example, part of an inner housing part which is moveably mounted in the insulating material housing 4. Apertures 6 are provided in the protective plate 5 in order to guide connection contacts 7, which are provided with electric shock protection by the protective plate 5, in the direction of a connection terminal 2 and to electrically conductively connect the connection contacts 7 to mating contacts (not illustrated) of the connection terminal 2.

It can also be seen that the connection contacts 7 are guided in the interior of the insulating material housing 4 by positioning webs 8 which are rigidly connected to the insulating material housing 4 and are arranged on either side of the connection contacts 7. This ensures that the connection terminals 7 are moved only in the vertical direction and are aligned with the apertures 6 in a connection position.

The connection contacts 7 are moved vertically with the aid of an operating housing part 9 to which the connection contacts 7 are fixed. The operating housing part 9 forms, as illustrated, part of the cover termination of the insulating material housing 4 and is accommodated and guided by the side walls which extend from the cover section, perpendicularly downward in the direction of the plane of the apertures 6, into guide grooves 10 in the insulating material housing 4.

The guide grooves 10 are formed by the outer wall of the insulating material housing 4 and a web 11, which projects from the outer wall of the insulating material hosing 4, in the interior. The connection contacts 7 are electrically conductively connected to connection line connections 12 which are integrated in the insulating material housing 4 and are intended to be connected to a power supply line for the electrical device.

However, the connection line connections 12 can optionally project from the insulating material housing and have, for example, insulation-displacement contact connections (IDC) for an insulation-displacement terminal contact connection. The connection line connections 12 can, for example, also have plugs and/or sockets arranged on the outer face of the insulating material housing 4 or be directly connected to an integrated power supply cable.

When the operating housing part 9 is operated by being pushed down in the direction of the connection terminal 2, in the protected position the connection contacts 7 would rest on the protective plate and, under certain circumstances, could be deformed as a result. Therefore, the operating housing, part 9 has a locking bar 13 which extends from the cover section of the operating housing part 9 perpendicularly downward in the direction of the protective plate 5. Locking bar apertures S are provided in the protective plate 5 and also the base wall, which adjoins said protective plate, of the insulating material housing 4, said locking bar apertures being aligned with one another when the insulating material housing 4 is moved in relation to the protective plate 5 to a connection position in which the apertures 6 for the connection terminals 9 are also aligned with apertures (which are not visible) in the insulating material housing 4 and the mating contacts which are provided in the connection terminal 2.

As a result, the blocking bar 13 can slide through the blocking bar apertures S in the connection position and therefore allows the operating housing part 9 to be pushed down in the direction of the connection terminal 2. The relative movement of the insulating material housing 4 and the protective plate 5, which is arranged in the interior of the insulating material housing 4, is made possible on account of the protective plate 5 having a guide element 14 which is operatively connected to the connection terminal 2 in order to secure the protective plate 5 relative to the connection terminal 2. The guide element 14 can be, for example, an aperture in which a guide pin 15 of the connection terminal 2 engages, said guide pin projecting from the connection terminal 2 upward out of the device housing plate 3.

It can be seen that the guide pin 15 is mounted on a connection terminal dome 16 which projects from the connection terminal 2 through an opening in the device housing plate 3. This connection terminal dome 16 forms a stop for an angled stop profile 17 which projects from the base wall of the insulating material housing 4 downward in the direction of the connection terminal 2. The stop profile 17 is additionally guided by a latching lug 18 of the connection terminal 2.

The connection adapter 1 is connected to the connection terminal 2 in such a way that first the guide pin 15 is passed through the guide element 14 which is designed as an aperture. As a result, the position of the protective plate is aligned with the connection terminal 2 and fixed when the connection adapter 1 is moved further. The insulating material housing is then moved to the right in relation to a connection terminal 2. The alignment and guidance is ensured by the angled connection profile 17 which rests on the latching lug 18. The insulating material housing 4 is pushed to the right, with the protective plate 5 remaining still, until the apertures 6 through which the connection contacts 7 are passed are aligned with corresponding apertures in the base wall of the insulating material housing 4 and with the mating contacts of the connection terminal 2, and additionally the locking bar apertures S are aligned with one another. This so-called latching position is reached when the connection profile 17 rests on the connection terminal dome 16, as a result of which a further movement of the insulating material housing 4 is prevented. In this latching position, it is now possible to push the operating housing part 9 downward in the direction of the connection terminal 2 since the locking bar 13, which has an L-shaped projection, now no longer rests on the upper face of the connection terminal 2 by way of its narrow end and no longer rests on the protective plate by way of its projection, but rather can slide through the aligned locking bar apertures S in the direction of the connection terminal 2.

Therefore, the operating housing part 9 is no longer locked, but rather released. On account of the operating housing part 9 being pushed down, the connection contacts 7 are guided downward through the apertures 6 into the mating contacts of the connection terminal 2 and therefore establish an electrical connection between the connection adapter 1 and the connection terminal 2.

Conversely, when the connection adapter 1 is disconnected, the L-shaped locking bar aperture S ensures that the connection contacts 7 can be moved only after a minimum distance from the protective plate 5 is reached, this distance being defined by the projection of the locking bar 13. The narrow end of the locking bar 13 additionally forms a stop for the connection terminal dome 16 and therefore ensures—together with the connection profile 17—controlled positioning and guidance.

The electrical connection of the electrical connection contacts 7 to the line connections 12 can be established either by means of flexible, hard-wired lines, via sliding contacts, via insulation-displacement terminal contacts or via a clamping contact which establishes an electrical contact between the electrical contacts 7 and the associated connection line connections 12 in the end position when the electrical connection contacts 7 are electrically conductively connected to the corresponding mating contacts of the connection terminal 2.

The connection adapter 4 can be disconnected from the connection terminal 2 only by the reverse sequence by, first, the operating housing part 9 being moved upward, this resulting in the locking bar 13 lifting the block on relative movement between the insulating material housing 4 and the protective plate 5, and the insulating material housing 4 then being moved to the left. This ensures, with the aid of the operative connection of the guide pin 15 and the guide element 14 which is in the form of an aperture, that the protective plate 5 falls into a protection position in which the electrical connection contacts 7 are protected against being touched. Auxiliary means which are subject to wear, such as springs, are not required but may optionally be provided. Instead, the pure movement sequence of fastening and disconnecting the connection adapter 1 is utilized.

According to the teaching of the present invention, the connection adapter guides and connection terminal guides, which are formed on the connection terminal dome 16 and the stop profile 17, are not only designed, as described, to guide and latch the connection adapter 1 on the connection terminal 2 but, taking into account the connection assignment of the connection adapter 1 and connection terminal 2, are matched to one another such that it is possible to guide a connection adapter 1 on a connection terminal 2 or vice versa only given a corresponding connection assignment, usually on the insulating material housing, of the contacts and mating contacts. The connection assignment can be visibly indicated, for example, as a functional association of the contacts and mating contacts on the insulating material housing.

Figure 2:
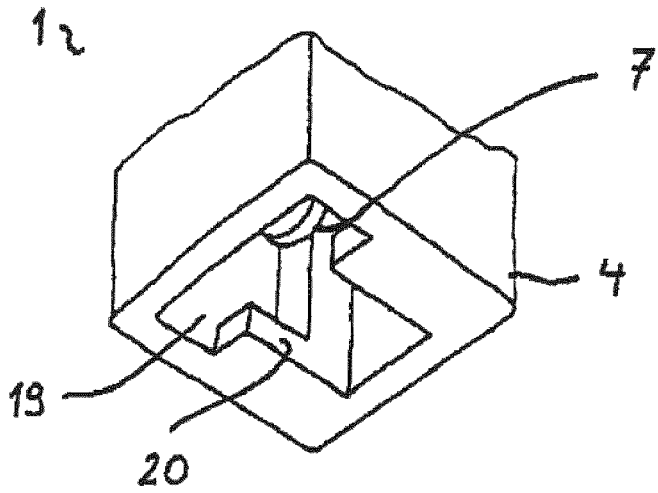
FIG. 2 shows a perspective illustration of a connection region of a connection adapter with connection terminal guides.

FIG. 2 shows a perspective view of the connection region of a connection adapter 1. An electrical contact is accommodated in the insulating material housing 4, it being possible to move said electrical contact in accordance with the manner illustrated in the above-described exemplary embodiment in relation to FIG. 1. A guide channel is also formed in the connection region of the insulating material housing 4 by recesses 19 and projections 20, it being possible for a connection terminal dome 16 of a corresponding connection terminal 2 to be inserted into said guide channel and guided to a latching position. In the latching position, the electrical contact 7 can then be connected to a corresponding mating contact of the connection terminal 2.

Figure 3:
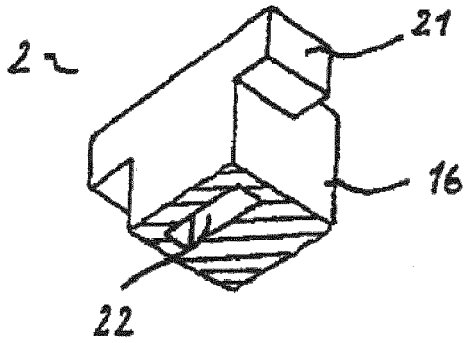
FIG. 3 shows a perspective illustration of a detail of a connection region of a connection terminal with connection adapter guides.

It is clear that two opposite wing regions are created by the recesses, said wing regions being wider than a region adjoining them. The recesses 19 therefore form a T shape which is partly delimited by the projections 20. The projections 20 serve to guide the connection terminal 2 to a latching position in which the projections 20 are situated above and adjacent to corresponding projections 21 of the connection terminal 2, as illustrated in FIG. 3. The connection terminal sketched in FIG. 3 is accordingly T-shaped in profile but is shorter in order to be inserted first into the recess 19 in the connection terminal dome 16, moved downward beneath the projections 20 and then moved transverse to the insertion direction, until the latching position is reached, the connection terminal 2 being held in the latching position by the projections and the projections 21 which rest on them, with the projections 21 butting against the boundary walls which project at a right angle from the projection 20 of the connection adapter. In this latching position, the electrical contact 7 can then be moved to the mating contacts of the connection terminal 2 through a contact, guide opening 22 in the connection terminal dome 16.

Figure 4:
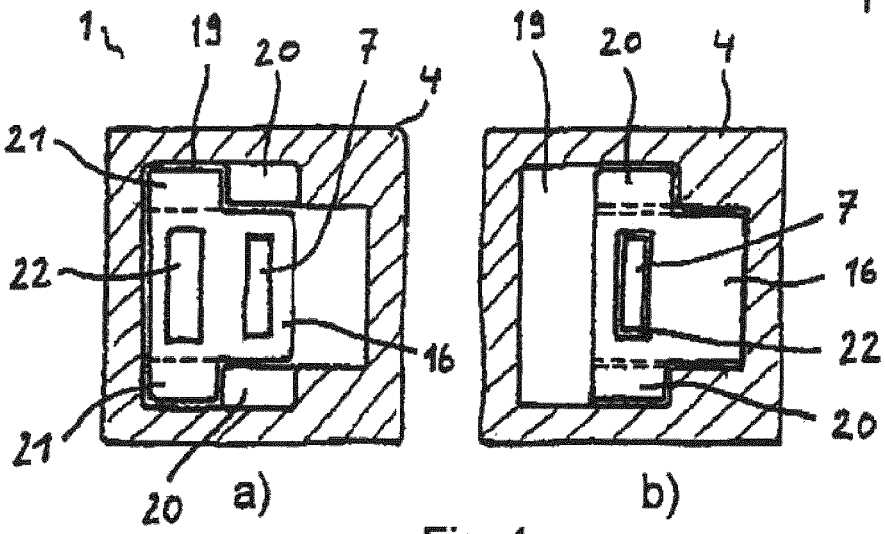

The movement sequence can be seen more clearly in the plan view sketched in FIG. 4.

FIG. 4*a*) shows a plan view of the connection region of a connection adapter 1 into which the connection terminal dome 16 of a corresponding connection terminal is inserted as far as a stop position. It can be seen that the projections 21 projecting from the connection terminal dome 16 are inserted into corresponding apertures 19 in the connection region in the insulating material housing 4 of the connection adapter 1 and the connection terminal dome 16 is moved downward until the projections 21 are situated beneath the plane defined by the projections 20.

After reaching the stop position, the connection terminal dome 16 is moved to the right, transverse to the insertion direction, until the latching position illustrated in FIG. 4*b*) is reached. In the latching position, the projections 20 in the insulating material housing 4 of the connection adapter 1 are situated above the corresponding projections 21 on the connection terminal dome 16 and in this way hold the connection terminal dome 16 against the insulating material housing 4 of the connection adapter 1.

Whereas the contact passage opening 22 in the connection terminal dome 16 are not aligned with the electrical terminal 7 of the connection adapter 1 in the stop position illustrated in FIG. 4*a*, the contact passage opening 22 and the contact 7 are matched to one another in the latching position illustrated in FIG. 4*b*) such that the contact 7 which is designed as a contact pin can pass through the contact passage opening 22, as far as a mating contact of the connection terminal 2.

The connection adapter guides and connection terminal guides formed by the projections 20, 21 and recesses 19 can be used not only to guide and hold the connection adapter 1 on the connection terminal 2 but, rather, the connection adapter guides and connection terminal guides are also designed as coding elements in order to prevent incorrect plug-connection of a connection adapter 1 on a connection terminal 2 if the connection assignment, for example the association of protective earthing conductor, neutral conductor and phase conductors, or, under certain circumstances, the pole numbers of the connection adapter 1 and connection terminal 2, do not correspond.

FIGS. 5*a*) to *d*) show, by way of example, some possible refinements of the connection adapter guides and connection terminal guides for coding purposes.

FIGS. 5*a*) and *b*) show a first coding of the connection adapter (FIG. 5*a*) and the connection terminal (FIG. 5*b*). In this case of this coding, the projections 21 are located directly opposite each other on the connection terminal dome 16, so that the T profile described in connection with FIGS. 2 to 4 is achieved.

FIGS. 5*c*) and *d*) show a second type of coding, in the case of which the projections 21 are opposite each other and obliquely offset in relation to one another on the connection terminal dome 16, as sketched in FIG. 5*d*). In a corresponding manner, the projections 20 are located opposite each other and obliquely offset in relation to one another in the insulating material housing 4 of the connection adapter 1. The recesses 19 are also arranged obliquely opposite one another (FIG. 5*c*).

FIGS. 6*a*) to *d*) show, by way of example, different designs of the connection adapter guides on the connection dome 16 of a connection terminal 2 in profile. In addition to the projections 21 which are directly opposite one another on the connection terminal dome 16 (FIG. 6*a*) and the projections 21 which are located obliquely opposite and arranged offset in relation to one another according to FIG. 6*b*), further projections 21 which enter corresponding recesses 19 can also be provided.

FIGS. 6*c*) and *d*) show variants in which two projections 21 are arranged, in a manner spaced part from one another by a recess 23, on one side of the connection terminal dome 16. This recess 23 can, for its part, surround a projection 20 on the insulating material housing 4 of the connection adapter 1.

Each of these refinements is provided for a specific, associated connection assignment of connection adapter 1 and connection terminal 2, and therefore a connection adapter and a connection terminal with different connection assignments cannot be connected to one another.

FIG. 7 shows a perspective view of a connection adapter 1 which is provided for fastening to a device connection terminal (not illustrated). The device connection terminal can, for example, be a luminaire connection terminal which is incorporated in a mounting plate of a luminaire.

The connection adapter has an upper housing part 24 which is mounted on a lower housing part 25 such that it can move downward in the Z direction. A first plug contact arrangement 26*a* and a second plug contact arrangement 26*b* are integrated in the upper housing part 24. In the illustrated exemplary embodiment, the plug contact arrangements 26*a*, 26*b* are attached, opposite one another, to the side walls of the upper housing part and extend in opposite directions. It is feasible, as an alternative or in addition to this, for a plug contact arrangement to be provided on the upper face of the upper housing part 24, said plug contact arrangement extending upward opposite the movement direction Z. This plug arrangement can then be provided with insulation-displacement terminal contacts, and therefore continuous lines can be laid on the upper face of the upper housing part 24 and connected to the insulation-displacement terminal contacts.

Connection contacts (not visible) are incorporated in the plug contact arrangements 26*a*, 26*b* in order to make contact with corresponding plug/socket contacts of conductor connection plugs or conductor connection sockets which can be mounted on the plug contact arrangements.

Latching hooks 27*a*, 27*b* which project laterally from the lower housing part 25 and have projections in the insertion direction Z and locking feet 28*a*, 28*b* at their ends facilitate mounting of the connection adapter 1 on a device connection terminal. After the locking feet 28*a*, 28*b* are inserted into openings in a mounting plate in which a device connection terminal is incorporated, the connection adapter 1 can then be guided into a clamping position by the openings in the mounting plate and the latching hooks 27*a*, 27*b* which are located in the openings.

Locking fingers 29*a*, 29*b* project from the upper housing part 24, said locking fingers being matched to the latching hooks 27*a*, 27*b*, being oriented parallel to said latching hooks and, in the latching position, preventing the latching hooks 27*a*, 27*b* from sliding out of the openings (not illustrated) in the mounting plate.

It can also be seen that guide tabs 30*a*, 30*b* are arranged on the two opposite side walls of the upper housing part, said guide tabs being guided in a groove 32 which is terminated by a transverse beam 31 and, with the aid of a stop lug 33, preventing the upper housing part 24 from being completely withdrawn from the lower housing part 25 in the upward direction, by the stop lug 33 butting against the transverse beam 31 in an inoperative position.

Locking tabs 34*a*, 34*b* are also integrally formed, for example, on the upper housing part 24, said locking tabs, in the clamping state in which the upper housing part is pushed onto the lower housing part 25 in the Z direction, being latched to the lower housing part 25 and thus securing the upper housing part 24 in the clamping position on the lower housing part 25.

FIG. 8 shows the connection adapter 1 from FIG. 1 in the clamping position which is reached when the connection adapter 1 is pushed onto a device connection terminal and the upper housing part 24 is moved downward in the Z direction. In this state, the locking fingers 29*a*, 29*b* secure the directly adjacent latching hooks 27*a*, 27*b* against sliding out of openings in a mounting plate. In addition, the upper housing part 24 is fixed to the lower housing part 25 with the aid of the locking tabs 34*a*, 34*b*, and therefore the upper housing part 24 cannot be withdrawn from the lower housing part 25 with high forces even when lines which are connected to the plug contact arrangements 26*a*, 26*b* are pulled.

FIG. 9 shows the internal structure of the connection adapter 1 in the inoperative position according to FIG. 7. It is clear that connection contacts 35*a*, 35*b* which are electrically conductively connected to one another by a busbar section 36 are each accommodated in the upper housing part 24 in the region of the plug contact arrangements 26*a*, 26*b*. The connection contacts 35*a*, 35*b* can be integrally formed, preferably together with the busbar section 36, from a sheet metal material.

An adapter contact 37 projects downward from the busbar section 36 in the direction of the lower housing part 25. The adapter contact 37 is mechanically electrically conductively connected to the busbar section 36 and can be produced as a separate part, this making assembly easier. However, it is also feasible for the connection contacts 35*a*, 35*b*, busbar section 36 and adapter contact 37 to be integrally formed.

The adapter contact 37 is guided by way of its free end into its guide opening 38 in a guide plate 39. A moveably mounted protective plate 40 is provided adjacent to the guide plate 39.

In addition, guide profiles 41 are provided in the lower end region of the lower housing part 25, said guide profiles being matched to domes 42 of the device connection terminal which project from an adjacent device connection terminal (not sketched) in order, in the illustrated inoperative position, to mount the connection adapter 1 onto the domes 42 and to move the connection adapter 1 to a clamping position relative to the device connection terminal.

The clamping position of the connection adapter 1 is illustrated in FIG. 10.

When the connection adapter 1 is mounted on the domes 42 of the device connection terminal, a holding finger 43 which projects downward from the protective plate 40 engages in an opening in the adjacent dome 42 in order to fix the protective plate 40 in a position on the dome 42. The connection adapter 1 can then be moved transversely on the dome 42 so that the lower housing part 25, together with the upper housing part 24, moves in relation to the fixed protective plate 40 and in this way passage openings in the protective plate 40 are brought into alignment with the adapter contacts 37 in the clamping position (FIG. 10). As a result, the adapter contacts 37, which are protected, by the protective plate 40, against being touched in the inoperative position, are released to such an extent that they can pass through the passage openings in the protective plate 40 and insertion openings in the domes 42 of the device connection terminal in order to engage with corresponding contacts in the device connection terminal. In this way, the device connection terminal makes electrical contact with the plug contact connections of the plug contact arrangement 26*a*, 26*b* via the adapter contacts 37.

In order to disconnect the connection adapter 1 from a device connection terminal, the upper housing part 24 is again pushed upward away from the lower housing part and the connection adapter 1 is then withdrawn transversely from the domes 42. As a result of the protective plate 40 being fixed to the domes 42 by means of the holding fingers 43, the protective plate 40 is again moved to the secured position when the adapter contacts 37 in the upper and lower housing parts 24, 25 are drawn back. The protective plate 40 is used to prevent the adapter contacts 37 from being touched, this being undesirable, said adapter contacts under certain circumstances may have voltage potential applied to conductors which are connected to the plug contacts.

The plug contact arrangements 26*a*, 26*b* can have additional locking elements 44 in a manner which is known per se in order to secure mounted connection plugs on the plug contact arrangements 26*a*, 26*b*.

FIG. 11 shows a perspective view of an adapter contact 37 which is integrally connected to a busbar section 36 and mutually opposite connection contacts 35*a*, 35*b* and is inserted into an associated guide opening 38 in a guide plate 39 and enters an insertion opening in a corresponding dome 42 of a device connection terminal 2 through a passage opening in the protective plate 40. The connection contacts 35*a*, 35*b* may be, for example as illustrated, in the form of plug connector contacts. In this case, a spring fork (left-hand connection contact 35*a*) makes contact with a knife contact (compare right-hand connection contact 35*b*) which is inserted into the fork contact. However, other types of connection contacts can equally be used, such as tension spring connection terminals, insulation-displacement terminal contacts, screw contacts or the like.

FIG. 12 shows a perspective view of a detail of a connection adapter 1 with adapter contacts 37, in which connection contacts 35*c* are integrally formed above the adapter contacts 37 using insulation-displacement terminal technology (IDC). A plug contact arrangement can be provided on the upper face of the upper housing part 24 in a simple and space-saving manner by virtue of the insulation-displacement terminal contacts which are integrally formed with the adapter contact 37 at the upper end. In this case, the conductors which are to be connected are inserted into conductor receptacles which are formed on the upper housing part 24 and are pressed into the insulation-displacement terminal contacts 35*c* with the aid of a cover and possibly clamping tongs. The cover is then latched and/or welded to the upper housing part 24.

FIG. 13 shows a perspective view of a further exemplary embodiment of a connection adapter 1, in which connection contacts 35*a*, 35*b* are associated with associated adapter contacts 37 with the aid of bridges 45. These bridges 45 can be arranged above the adapter contacts 37 and preferably can be inserted, for example, in fork contacts 46 which are integrally formed at the upper free end of the adapter contacts 37. The bridge plane in which the fork contacts 46 are arranged is therefore situated above the adapter contacts 37, and therefore the overall size of the connection adapter 1 can be kept small. In this case, the connection contacts 35*a* and 35*b* of the plug contact arrangements 26*a*, 26*b* are rigidly connected to one another via the bridges 45.

The bridges 45 can be mounted during production and be incorporated in the upper housing part 24. However, it is also feasible for the bridges 45 to be integrated in a separate bridge plug which is mounted on the adapter connection housing which is partly open in order to accommodate the bridge plug in the region of the fork contacts 46.

The invention claimed is:

1. A set comprising a connection adapter (1) and connection terminal (2), with the connection adapter (1) having electrical contacts (7) for connection to a corresponding mating contact of the connection terminal (2), the mating contacts each being accommodated in a connection terminal dome (16), which is formed from insulating material, such that the mating contacts are accessible to a contact (7) of the connection adapter (1) through a respective contact guide opening (22) in the associated connection terminal dome (16), and with the connection terminal domes (16) having connection adapter guides which are designed to cooperate with corresponding connection terminal guides on the connection adapter (1) for guiding the connection adapter (1) from a mounting position, in which the connection adapter (1) is mounted on the connection terminal (2) in a matching manner and from which the connection adapter (1) and connection terminal (2) can be plug-connected, to a latching position, in which the connection adapter (1) is seated and held on the connection terminal (2) such that the electrical contacts (7) of the connection adapter (1) and the corresponding mating contacts of the connection terminal (2) can be moved relative to one another in order to make electrical contact, characterized in that the connection adapter guides and connection terminal guides are also matched to one another such that a coding is provided as a function of the provided connection assignment of the contacts present in the connection adapter (1) and the connection terminal (2) for making mutual contact, said coding permitting a connection adapter (1) to be guided on a connection terminal (2), or vice versa, only given a corresponding connection assignment.

2. The set as claimed in claim 1, characterized in that the connection adapter guides and connection terminal guides are formed by projections (20, 21) and recesses (19) in the insulating material of the connection terminal dome (16) and/or a corresponding plug attachment region of the connection adapter (1).

3. The set as claimed in claim 1, characterized in that those sections of the connection adapter guides and connection terminal guides which form a coding are present at the free end of the connection terminal dome (16) of the connection terminal (2), and therefore a connection adapter (1) which does not match is prevented from being mounted as early as before the movement process.

4. The set as in claim 1, characterized in that the connection terminal dome (16) is integrally formed with an insulating material housing of the connection terminal (2).

5. The set as in claim 1, characterized in that the connection adapter guides and the connection terminal guides define a guide path of the kind such that, in the first step of the contact-making process, the connection adapter (1) and connection terminal (2) can be moved toward one another, the connection adapter (1) and connection terminal (2) can be moved transverse to one another after a connection position is reached, and the electrical contacts (7) in the connection adapter (1) can be moved toward one another relative to the corresponding mating contacts for making mutual contact after the latching position is reached.

6. A connection terminal (2) for a set as in claim 1, having a plurality of mating contacts which are each accommodated in an associated connection terminal dome (16) which is formed from insulating material and which are each accessible to a respectively associated contact (7) of a connection adapter (1) via an associated contact guide opening (22) in the connection terminal dome (16), with the connection terminal dome (16) having connection adapter guides which are designed to cooperate with corresponding connection terminal guides on a matching connection adapter (1) for guiding the connection adapter (1) from a mounting position, in which the connection adapter (1) is mounted on the connection terminal (2) in a matching manner and from which the connection adapter (1) and connection terminal (2) can be plug-connected, to a latching position, in which the connection adapter (1) is seated and held on the connection terminal (2) such that the electrical contacts (7) of the connection adapter (1) and the corresponding mating contacts of the connection terminal (2) can be moved relative to one another in order to make electrical contact, characterized in that the connection adapter guides are also matched to connection terminal guides of a corresponding connection adapter such that a coding is provided as a function of the provided connection assignment of the contacts of the connection terminal (2) for making contact with corresponding mating contacts of a matching connection adapter (1), said coding permitting a connection adapter (1) to be guided on the connection terminal (2), or vice versa, only given a corresponding connection assignment.

7. The connection terminal (2) as claimed in claim 6, characterized in that the connection adapter guides are formed by projections (21) and recesses (19) in the insulating material of the connection terminal dome (16).

8. The connection terminal (2) as claimed in claim 6, characterized in that those sections of the connection adapter guides which form a coding are present at the free end of the connection terminal dome (16), and therefore a connection adapter (1) which does not match is prevented from being mounted as early as before the movement process.

9. The connection terminal (2) as claimed in claim 6, characterized in that the connection terminal dome (16) is integrally formed with an insulating material housing of the connection terminal (2).

10. A connection adapter (1) for a set as claimed in claim 1, having a plurality of electrical contacts (7) in an insulating material housing (4), which contacts are accommodated in a manner protected against contact from the outside by a protective plate (5) in the unlocked state, and having unlocking elements (13) which, after a latching position is reached, allow the electrical contacts (7) to move through openings in the protective plate (5) in the direction of mating contacts of a connection terminal (2), with connection terminal guides being integrally formed in the insulating material housing (4) adjacent to the contacts (7) in such a way that the connection adapter (1) from a mounting position, in which the connection adapter (1) is mounted on the connection terminal (2) in a matching manner and from which the connection adapter (1) and connection terminal (2) can be plug-connected, to a latching position, in which the connection adapter (1) is seated and held on the connection terminal (2) such that the electrical contacts (7) of the connection adapter (1) and the corresponding mating contacts of the connection terminal (2) can be moved relative to one another in order to make electrical contact, characterized in that the connection terminal guides are also matched to connection adapter guides of a corresponding connection terminal (2) such that a coding is provided as a function of the provided connection assignment of the contacts present in the connection adapter (1) for making contact with corresponding mating contacts of a connection terminal (2), said coding permitting the connection adapter (1) to be guided on a connection terminal (2), or vice versa, only given a corresponding connection assignment.

11. The connection adapter (1) as claimed in claim 10, characterized in that the protective plate (5, 40) has at least one guide element (14), for example a holding finger (43), which projects downward in the direction of the connection face for a connection terminal (2), for holding the protective plate (5, 40) in a fixed position with respect to the connection terminal (2) when the guide element (14) interacts with the connection terminal (2), while a lower and an upper housing part (24, 25) of the connection adapter (1) are moved relative to the protective plate (5, 40) when said connection adapter latches onto the connection terminal (2) in order to align the passage openings with the adapter contacts (37), and in that the upper housing part (25) has a locking bar (13) which extends from the upper housing part (24) perpendicularly downward in the direction of the protective plate (5, 40), and in that locking bar apertures (S) are provided in the protective plate (5, 40) and in the lower housing part (25), said locking bar apertures being aligned with one another when the protective plate (5, 40) is moved in relation to the lower housing part (25) to a connection position for fastening the connection terminal (2), with the locking bar apertures (S) being matched to the locking bar (13), so that the locking bar (13) can slide through the locking bar apertures (S) in the connection position, and therefore the upper housing part (24) can be pushed down in the direction of the protective plate (5, 40) and the connection terminal (2).

12. A connection adapter (1) having an upper housing part (24) which is mounted on a lower housing part (25), such that it can move relative to the lower housing part (25), and accommodates adapter contacts (37) which can be moved together with the upper housing part (24), and having a protective plate (40) which has passage openings for the adapter contacts (37) and is mounted such that it can be moved relative to the adapter contacts (37) in such a way that the adapter contacts (37) are recessed in the upper housing part (24) such that they are concealed by the protective plate (40) in an inoperative position in which the connection adapter (1) is separated from a corresponding device connection terminal (2), and projects through the passage openings in the protective plate (40) into clamping points of the device connection terminal (2) in a clamping position in which the connection adapter (1) is mounted at least partly on a corresponding device connection terminal (2), characterized in that the protective plate (40) is mounted in the lower housing part (25) and at least one plug contact arrangement (26*a*, 26*b*) is integrated in the upper housing part (24), said plug contact arrangement in each case having a group of connection contacts (35*a*, 35*b*) which are electrically conductively connected to associated adapter contacts (37).

13. The connection adapter (1) as claimed in claim 12, characterized in that latching hooks (27*a*, 27*b*) project from the lower housing part (25), and the upper housing part (24) has locking fingers (29*a*, 29*b*) which are matched to the latching hooks (27*a*, 27*b*), with the latching hooks (27*a*, 27*b*) and the locking fingers (29*a*, 29*b*) being designed such that, after the lower housing part (25) is latched by the latching hooks (27*a*, 27*b*) engaging in openings in a mounting plate, the locking fingers (29*a*, 29*b*) can be positioned in the openings when the upper housing part (24) moves behind the latching hooks (27*a*, 27*b*), and stop the latching hooks (27*a*, 27*b*) from being drawn out of the openings.

14. The connection adapter (1) as claimed in claim 12, characterized in that the lower face of the lower housing part (25), which lower face is intended to rest on a device connection terminal (2), has guide profiles (41) which are matched to projecting domes (42) of the device connection terminal (2) for pushing on and latching the connection adapter (1) to the device connection terminal (2).

15. The connection adapter (1) as claimed in claim 12, characterized in that connection contacts (35*a*, 35*b*, 35*c*) of at least one of the at least one plug contact arrangement (26*a*, 26*b*) are in the form of insulation-displacement terminal contacts.

16. The connection adapter (1) as claimed in claim 15, characterized in that the insulation-displacement terminal plug contact arrangement is arranged above the adapter contacts (37) in the upper housing part (24), and a guide attachment with latching elements for latching onto the upper face of the upper housing part (24) and with line guide elements for laying and guiding lines to associated insulation-displacement terminal connection contacts is provided.

17. The connection adapter (1) as claimed in claim 12, characterized in that connection contacts (35*a*, 35*b*) of at least one of the at least one plug contact arrangement (26*a*, 26*b*) are in the form of spring-force terminal connections.

18. The connection adapter (1) as claimed in claim 12, characterized in that two plug contact arrangements (26*a*, 26*b*) are arranged opposite one another in the upper housing part (24), with the connection contacts (35*a*, 35*b*) being arranged in the intermediate space and projecting transverse to the alignment between the two plug contact arrangements (26*a*, 26*b*) downward in the direction of the lower housing part (25).

19. The connection adapter (1) as claimed in claim 12, characterized in that at least two plug contact arrangements (26*a*, 26*b*) are arranged one above the other on one side of the upper housing part (24).

20. The connection adapter (1) as claimed in claim 12, characterized in that the protective plate (5, 40) has at least one guide element (14), in particular a holding finger (43), which projects downward in the direction of the connection face for a connection terminal (2), for holding the protective plate (5, 40) in a fixed position with respect to the connection terminal (2) when the guide element (14) interacts with the connection terminal (2), while the lower and upper housing parts (24, 25) are moved relative to the protective plate (5, 40) when latching onto the connection terminal (2) in order to align the passage openings with the adapter contacts (37).

21. The connection adapter (1) as claimed in claim 12, characterized in that the upper housing part (24) has a locking bar (13) which extends from the upper housing part (24) to the lower housing part (25) perpendicularly downward in the direction of the protective plate (5, 40), and in that locking bar apertures (5) are provided in the protective plate (5) and in the lower housing part (25), said locking bar apertures being aligned with one another when the protective plate (5, 40) is moved in relation to the lower housing part (25) to a connection position for fastening the connection terminal (2), with the locking bars (13) being adapted, so that the locking bar (13) can slide through the locking bar apertures (S) in the connection position, and therefore the upper housing part (24) can be pushed down in the direction of the protective plate (5, 40) and the connection terminal (2).

* * * * *